US010260826B2

(12) United States Patent
Ask

(10) Patent No.: US 10,260,826 B2
(45) Date of Patent: Apr. 16, 2019

(54) APPARATUS AND METHOD FOR CLEANING HEAT TRANSFER PLATES

(71) Applicant: ALFA LAVAL CORPORATE AB, Lund (SE)

(72) Inventor: Torsten Ask, Lund (SE)

(73) Assignee: ALFA LAVAL CORPORATE AB, Lund (SE)

( * ) Notice: Subject to any disclaimer, the term of this patent is extended or adjusted under 35 U.S.C. 154(b) by 107 days.

(21) Appl. No.: 15/023,474

(22) PCT Filed: Nov. 6, 2013

(86) PCT No.: PCT/EP2013/073092
§ 371 (c)(1),
(2) Date: Mar. 21, 2016

(87) PCT Pub. No.: WO2015/067305
PCT Pub. Date: May 14, 2015

(65) Prior Publication Data

US 2016/0209134 A1 Jul. 21, 2016

(51) Int. Cl.
*B08B 3/02* (2006.01)
*F28G 1/16* (2006.01)
(Continued)

(52) U.S. Cl.
CPC ..... *F28G 1/163* (2013.01); *B05B 1/202* (2013.01); *B05B 13/04* (2013.01); *B08B 3/024* (2013.01);
(Continued)

(58) Field of Classification Search
CPC . B08B 3/02; B08B 3/024; F28G 1/166; F28G 9/005; F28G 1/16; F28G 1/163;
(Continued)

(56) References Cited

U.S. PATENT DOCUMENTS 1,720,557 A * 7/1929 Lenz ..... G03D 3/02 134/138
2,325,255 A * 7/1943 Lenz ..... G03D 3/02 134/158
(Continued)

FOREIGN PATENT DOCUMENTS

CN 1697959 A 11/2005
DE 10202406 B4 5/2004
(Continued)

*Primary Examiner* — Marc Lorenzi
(74) *Attorney, Agent, or Firm* — Birch, Stewart, Kolasch & Birch, LLP

(57) ABSTRACT

An apparatus and a method for cleaning heat transfer plates suspended between end plates of an open plate heat exchanger are provided. The apparatus includes a spraying device including a first rod, at least a first nozzle arranged on a nozzle side of the first rod, which nozzle side is arranged to face a first heat transfer plate side, a second rod and at least a second nozzle arranged on a nozzle side of the second rod, which nozzle side is arranged to face a second heat transfer plate side. The first and second rods are essentially parallel and connected. The spraying device has a first mode in which the first and second rods are arranged to move between the heat transfer plates in a first direction perpendicular to a longitudinal extension of the first and second rods and parallel to an extension plane of the heat transfer plates. Meanwhile, the first and second nozzles are arranged to spray cleaning fluid onto the first and second heat transfer plate sides, respectively.

15 Claims, 3 Drawing Sheets

(51) Int. Cl.

| | |
|---|---|
| ***B05B 13/04*** | (2006.01) |
| ***B05B 1/20*** | (2006.01) |
| ***F28G 15/00*** | (2006.01) |
| ***F28G 15/02*** | (2006.01) |

(52) U.S. Cl.
CPC ..... *F28G 1/166* (2013.01); *F28G 15/003* (2013.01); *F28G 15/02* (2013.01)

(58) Field of Classification Search
CPC . F28G 3/16; F28G 3/163; F28G 3/166; B05B 1/20; B01D 29/682; B01D 29/684
USPC ..... 165/5, 303
See application file for complete search history.

(56) References Cited

U.S. PATENT DOCUMENTS

| | | | | |
|---|---|---|---|---|
| 4,448,221 | A * | 5/1984 | Murray | B01D 25/164 118/315 |
| 4,497,363 | A | 2/1985 | Heronemus | |
| 5,564,371 | A * | 10/1996 | Ashton | F22B 37/483 122/379 |
| 5,893,753 | A * | 4/1999 | Hempel, Jr. | B08B 1/007 134/198 |
| 6,672,257 | B1 * | 1/2004 | Ashton, III | F22B 37/483 122/379 |
| 6,978,793 | B1 | 12/2005 | Krueger | |
| 7,273,516 | B2 | 9/2007 | Weidmann | |
| 7,418,997 | B2 * | 9/2008 | Martin | F28G 9/00 15/405 |
| 8,379,925 | B2 * | 2/2013 | Schilling | G06T 7/62 134/123 |
| 2002/0112748 | A1 * | 8/2002 | Niland | B08B 3/02 134/58 R |
| 2005/0173102 | A1 | 8/2005 | Jung | |
| 2006/0037736 | A1 * | 2/2006 | Heyman | F25B 47/00 165/95 |
| 2006/0266390 | A1 | 11/2006 | Lake | |
| 2009/0272409 | A1 * | 11/2009 | Petit | B60S 3/002 134/32 |
| 2012/0091065 | A1 * | 4/2012 | Xia | B01D 29/39 210/702 |
| 2012/0279525 | A1 | 11/2012 | Stone et al. | |

FOREIGN PATENT DOCUMENTS

| | | | |
|---|---|---|---|
| DE | 10 2005 030 633 | A1 | 1/2007 |
| ES | 2 364 822 | B1 | 4/2012 |
| KR | 10-1060674 | B1 | 8/2011 |
| WO | WO 99/45333 | A1 | 9/1999 |

* cited by examiner

APPARATUS AND METHOD FOR CLEANING HEAT TRANSFER PLATES

TECHNICAL FIELD

The invention relates to an apparatus and a method for cleaning heat transfer plates suspended between the end plates of an open plate heat exchanger.

BACKGROUND ART

Plate heat exchangers, PHEs, typically consist of two end plates in between which a number of heat transfer plates are arranged in an aligned manner, i.e. in a stack. To be properly positioned between the end plates, the heat transfer plates may engage with an upper carrying bar and a lower guiding bar, which bars extend between the end plates. In one type of well-known PHEs, the so called gasketed PHEs, gaskets are arranged between the heat transfer plates, typically in gasket grooves which extend along edges of the heat transfer plates. The end plates, and therefore the heat transfer plates, are pressed towards each other by means of some kind of tightening means, whereby the gaskets seal between the heat transfer plates. The gaskets define parallel flow channels between the heat transfer plates through which channels two fluids of initially different temperatures alternately can flow for transferring heat from one fluid to the other.

For a PHE to work properly, it may have to be cleaned at regular intervals, naturally depending on, among other things, the nature of the fluids fed through the PHE. In connection therewith, an operator typically loosens the tightening means before separating the end plates to open the PHE. In the open PHE the heat transfer plates are separable from each other by being pushed or pulled along the carrying and guiding bars. Typically, the operator washes one side of a first heat transfer plate before moving the first heat transfer plate to make the other side of it accessible. Thereafter, the operator washes the other side of the first heat transfer plate. This procedure is then repeated for each of the remaining heat transfer plates. The heat transfer plates are typically washed by being swilled off with water.

Cleaning of a PHE in the above described way may be time-consuming, especially if the PHE contains many and large heat transfer plates. Also, when cleaning large heat transfer plates, it may be difficult to reach upper portions of the heat transfer plates. The operator may have to use a ladder or similar which may be tiresome and associated with danger. Further, due to the human factor, some of the heat transfer plates may be carefully cleaned while others may be less carefully cleaned.

SUMMARY

An object of the present invention is to provide a possibility of fast, effective and consistent cleaning of the heat transfer plates suspended between the end plates of an open plate heat exchanger. The basic concept of the invention is to clean two heat transfer plate sides at a time in a way that is less manual than the known, above described, way.

An apparatus and a method for achieving the object above is defined in the appended claims and discussed below.

An apparatus according to the present invention is characterized in that it includes a spraying device which comprises a first rod and at least a first nozzle arranged on a nozzle side of the first rod. The nozzle side of the first rod is arranged to face a first heat transfer plate side. The spraying device further comprises a second rod and at least a second nozzle arranged on a nozzle side of the second rod. The nozzle side of the second rod is arranged to face a second heat transfer plate side. The first and second rods are essentially parallel and connected. The spraying device has a first mode in which the first and second rods are arranged to move between the heat transfer plates in a first direction. The first direction is perpendicular to a longitudinal extension of the first and second rods and parallel to an extension plane of the heat transfer plates. Meanwhile, the first and second nozzles are arranged to spray cleaning fluid onto the first and second heat transfer plate sides, respectively.

In that two heat transfer plate sides are cleaned simultaneously, the cleaning can be made faster than if only one heat transfer plate side should be cleaned at a time.

In that the cleaning of the heat transfer plates is automatized according to the present invention, cleaning of large, more particularly high, heat transfer plates is facilitated.

The first and second rods may be directly or indirectly connected. In that the first and second rods are connected, it may be easier control the spraying device, e.g. to make sure that the first and second rods, and thus the first and second nozzles, move in the same way along, and achieves the same cleaning of, the first and the second heat transfer plate side, respectively.

In that the movement of the first and second rods, and thus the first and second nozzles, between the heat transfer plates is controlled so as to occur as above specified, it may be ensured that all the heat transfer plates of the plate heat exchanger are cleaned properly and in essentially the same way.

The spraying device may be movable between the first mode and a second mode in which the spraying device is arranged, as seen perpendicularly to the extension plane of the heat transfer plates, outside the heat transfer plates. Thereby, when the spraying device is in the second mode, the heat transfer plates are movable perpendicularly to the extension plane of the heat transfer plates past the spraying device. Naturally, in the previous sentence, a relative movement is contemplated. In that the spraying device and the heat transfer plates are movable in relation to each other when the device is in its second mode, the apparatus may easily get access to, and clean, all the heat transfer plates of the plate heat exchanger.

The spraying device may be arranged to move, when arranged in the first mode, from a first to a second position in the first direction, for cleaning the first and second heat transfer plate sides. Thereafter, the spraying device may be arranged to take the second mode to allow heat transfer plate passage, move opposite the first direction and return to the first mode and the first position. The spraying device may be arranged to repeat the above procedure until each of the heat transfer plates has been cleaned.

The spraying device may be arranged to rotate about a rotation axis which is perpendicular to the extension plane of the heat transfer plates when shifting between the first and second modes. Thereby, a relatively small motion of the spraying device is enough to move it out of the way of the heat transfer plates.

The apparatus may further comprise a support bar arranged to be positioned outside the heat transfer plates as seen perpendicularly to the extension plane of the heat transfer plates. The support bar may extend essentially parallel to the first direction. The spraying device may engage with the support bar and be movable along the same to take the first and second positions. This solution enables a stable and straightforward construction of the inventive apparatus.

The first and second heat transfer plate sides may be comprised in two different heat transfer plates. Then, especially in connection with thin heat transfer plates, the spraying of cleaning fluid may cause bulging of the heat transfer plates if there is no support on the side of the heat transfer plates not being sprayed. However, the nozzle side of the first rod may face the nozzle side of the second rod. Then, the first and second rods, and thus the first and second nozzles, are arranged to be positioned on opposite sides of each of the heat transfer plates. By such a solution, support may be provided such that bulging of the heat transfer plates due to cleaning fluid spraying may be avoided.

The first direction may be vertical and downward. Then, dirty cleaning fluid may be prevented from soiling already cleaned surfaces of the heat transfer plates.

The spraying device may further comprise a curtain arrangement extending from the first rod and second rods and arranged outside the first and second nozzles as seen from the first and second heat transfer plate sides. Such a curtain arrangement is arranged to stop splashing of the cleaning fluid into the surroundings. It may comprise one continuous protective curtain or a plurality of separate protective curtains.

A method according to the present invention is characterized in that it comprises the step of moving a spraying device arranged in a first mode between the heat transfer plates and from a first to a second position in a first direction. The spraying device comprises a first rod and at least a first nozzle arranged on a nozzle side of the first rod. The nozzle side of the first rod is arranged to face a first heat transfer plate side. The spraying device further comprises a second rod and at least a second nozzle arranged on a nozzle side of the second rod. The nozzle side of the second rod is arranged to face a second heat transfer plate side. The first and second rods are parallel and connected. Further, the first direction is perpendicular to a longitudinal extension of the first and second rods and parallel to an extension plane of the heat transfer plates. The method further comprises the step of feeding cleaning fluid from the first and second nozzles onto the first and second heat transfer plate sides, respectively.

The above discussions of the benefits and advantages of the different embodiments of the inventive apparatus are naturally transferable to the different embodiments of the inventive method which are defined in the dependent method claims.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which FIG. 1 schematically illustrates a plate heat exchanger in side view and an apparatus for cleaning heat transfer plates in front view, FIG. 2 schematically illustrates the plate heat exchanger and the apparatus of FIG. 1 in top view, FIG. 3 schematically illustrates one of the heat transfer plates and the apparatus of FIG. 1 in side view in different positions and orientations, FIG. 4 schematically illustrates a cross section through a spraying device of the apparatus of FIG. 1.

DETAILED DESCRIPTION

Figure 1:
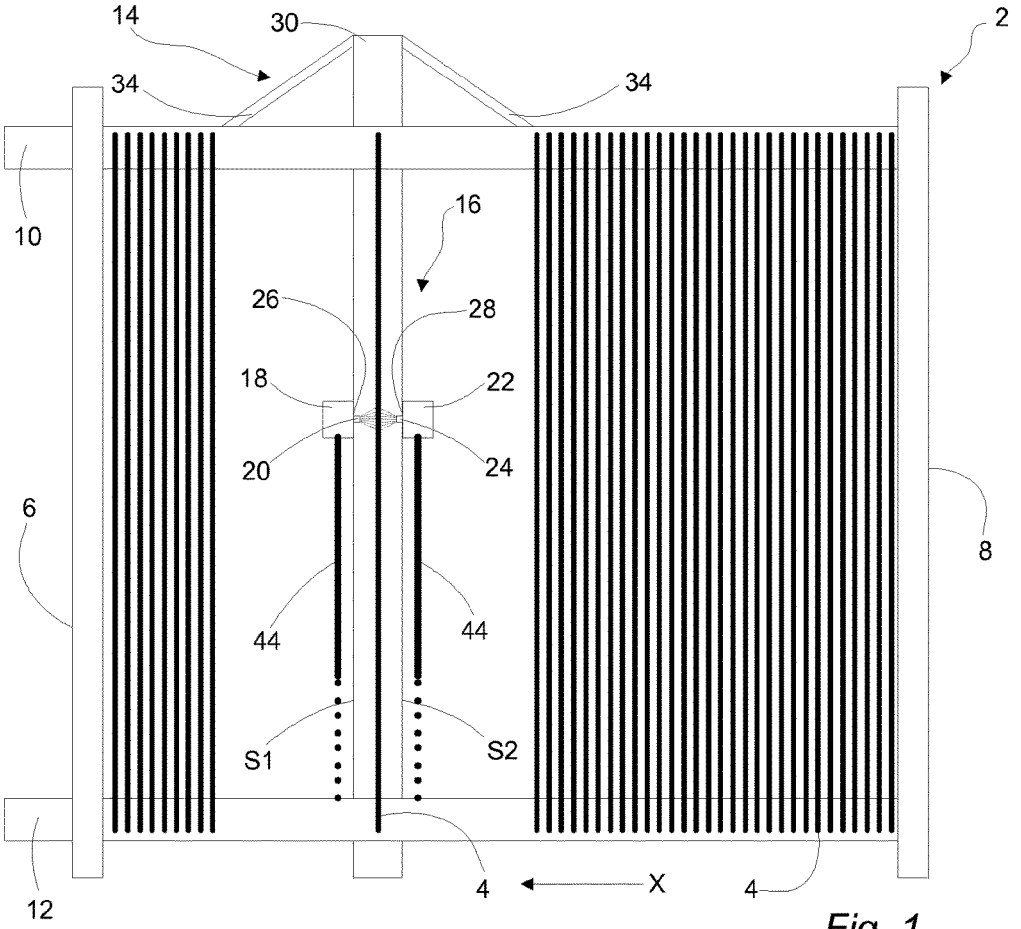
Figure 2:
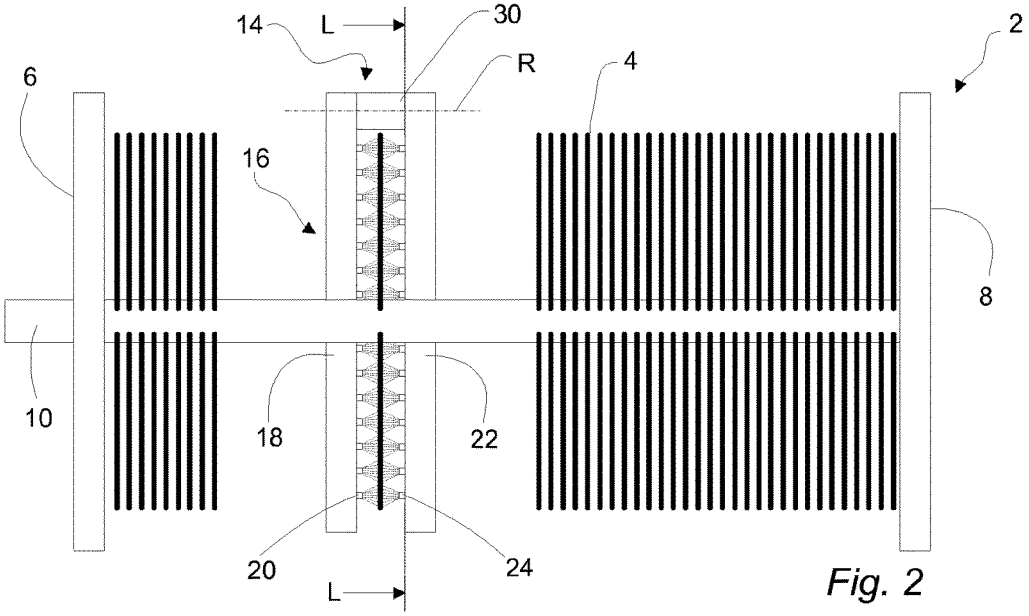

FIGS. 1 and 2 illustrate a gasketed plate heat exchanger 2 comprising a plurality of heat transfer plates 4 arranged between two end plates 6 and 8. The heat transfer plates 4 are suspended between the end plates 6 and 8 by engaging with an upper carrying bar 10 and a lower guiding bar 12 extending in parallel from the end plate 8 through the end plate 6. With reference to what was described by way of introduction, the plate heat exchanger 2 is in an open mode in FIGS. 1 and 2. Therefore, tightening means for pressing the end plates 6 and 8 towards each other for closing the plate heat exchanger 2 are not visible in the figures. The construction and function of a gasketed plate heat exchanger is well-known and will not be described in detail herein.

Figure 3:
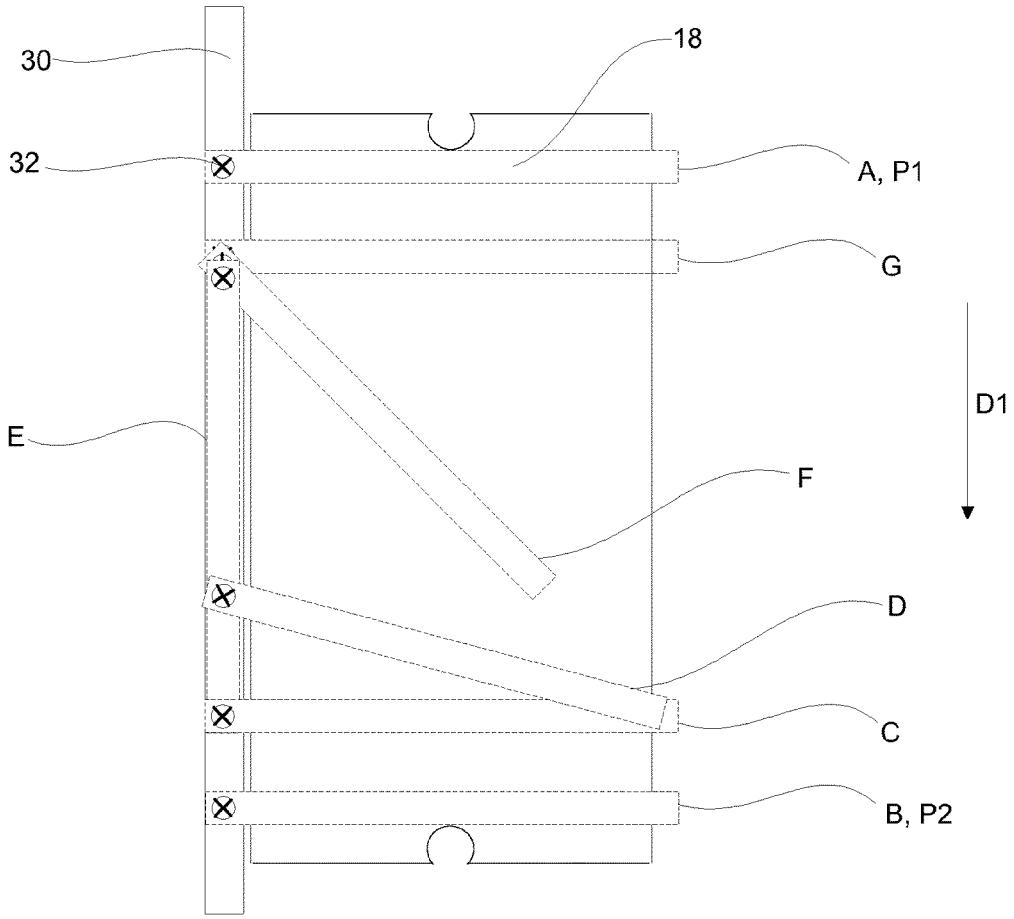
Figure 4:
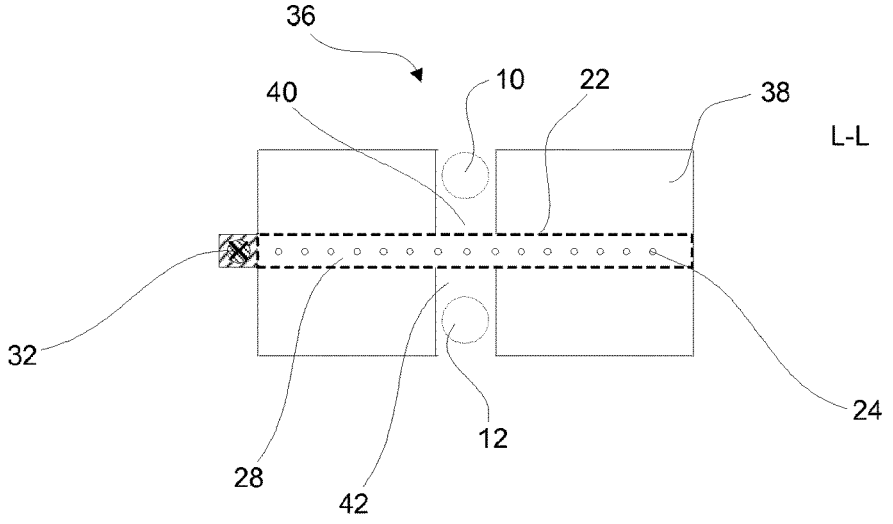

As is clear from the figures, in the open plate heat exchanger 2, the end plates 6 and 8 are sufficiently separated from each other to enable that the heat transfer plates 4 are separated from each other by being slid along the carrying and guiding bars 10 and 12. Thereby, cleaning of each individual heat transfer plate 4 is enabled. The cleaning is performed by means of an apparatus 14 which is illustrated in FIGS. 1-4. FIG. 4. illustrates a cross section through the apparatus 14 taken along the line L-L in FIG. 2.

The apparatus 14 comprises a spraying device 16, which in turn comprises a first rod 18, a plurality of first nozzles 20, a second rod 22 and a plurality of second nozzles 24. The first nozzles 20 are evenly distributed along a nozzle side 26 of the first rod 18 while the second nozzles 24 are evenly distributed along a nozzle side 28 of the second rod 22. The nozzle sides 26 and 28 of the first and second rods 18 and 22 are facing each and the first and second rods are essentially parallel.

The apparatus 14 further comprises a support bar 30 anchored to the ground and extending vertically upwards there from. As is clear form FIG. 2 the support bar 30 is positioned outside the heat transfer plates 4 as seen perpendicularly to an extension plane of the heat transfer plates (which extension plane is orthogonal to a figure plane of FIGS. 1 and 2). The support bar 30 has a length well exceeding a height of the plate heat exchanger 2 and it is arranged to support the spraying device 16. Accordingly, the spraying device 16, or more particularly the first and second rods 18 and 22 thereof, are articulately connected to the support bar 30 by a pivot 32 (FIGS. 3 and 4) extending through the first and second rods and the support bar. Thereby, the first and second rods are rotatable around a rotation axis R (FIG. 2) coinciding with a longitudinal axis of the pivot 32. Naturally, the pivot 32 also connects the first and second rods 18 and 22 to each other.

Further, the apparatus 14 includes connection means 34 (illustrated only in FIG. 1) for anchorage to the plate heat exchanger 2. The connection means 34 extend between the support bar 30 of the apparatus 14 and the carrying bar 10 of the plate heat exchanger 2 and make sure that the apparatus 14 stand steady during the heat transfer plate cleaning.

Also, as illustrated in FIG. 4 only, the apparatus 14 includes a curtain arrangement 36 comprising two protective essentially similar curtains 38 (of which only one can be seen) extending vertically along a respective one of the first and second rods 18 and 22, upwards and downwards there from. The protective curtains 38 are arranged between the first and second nozzles 20 and 24 and the first and second rods 18 and 22, respectively, and the purpose of them is to stop splashing of cleaning liquid to the surroundings. As is clear from FIG. 4, the protective curtains 38 have respective upper and lower apertures 40 and 42 which are arranged to receive the carrying and guiding bars 10 and 12, respectively (illustrated with ghost lines), as will be further discussed below.

The apparatus 14 further comprises means for supply of cleaning liquid to the first and second rods 18 and 22 for further distribution to the first and second nozzles 20 and 24. These means for cleaning liquid supply include hoses 44 connected to a cleaning liquid source (not illustrated). Details on how the cleaning liquid is fed from the cleaning liquid source to the individual first and second nozzles are omitted since this lies outside the essence of the present invention.

Figure 5:
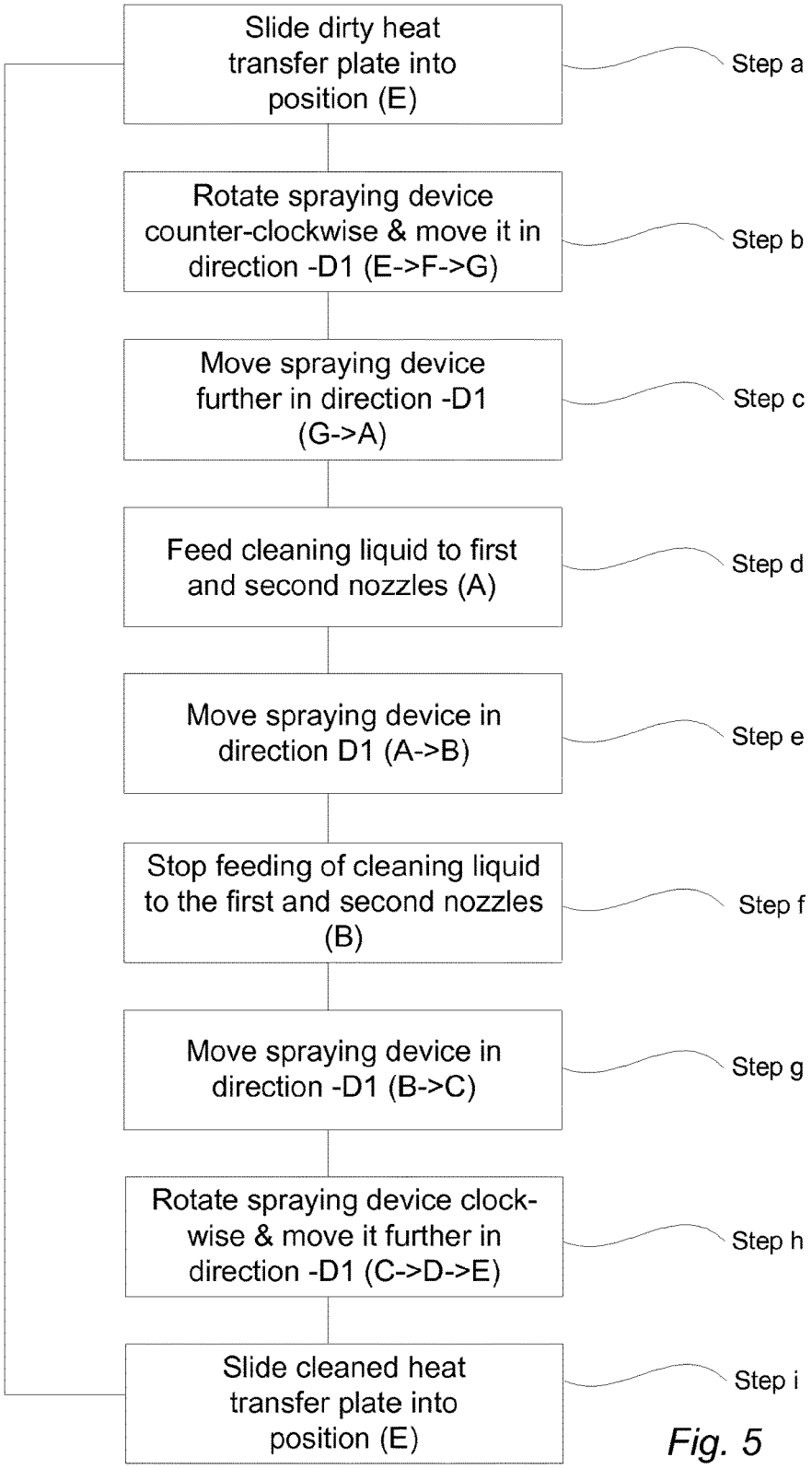
FIG. 5 is a flow chart illustrating a method for cleaning heat transfer plates.

The operation of the apparatus 14 in cleaning the heat transfer plates 4 will now be described with reference especially to FIGS. 3 and 5. FIG. 3 illustrate different states, i.e. different orientations and positions, of the spraying device and each reference letter A-G corresponds to a specific orientation and a specific position, i.e. a specific state. FIG. 5 contains a flow chart illustrating the cleaning method. In each block of the flow chart the state of the spraying device is given.

The spraying device 16 has a first mode and a second mode. In the first mode, a longitudinal extension of the first and second rods 18 and 22 is essentially horizontal and cleaning liquid is fed from the first and second nozzles 20 and 24. The spraying device may be in the first mode when it is in state A and B and when it is moving from state A to B in a first direction D1, which is vertical and downwards. State A and B correspond to an upper extreme first position P1 and a lower extreme second position P2, respectively, of the spraying device 16 when this is horizontally arranged. In the second mode, the longitudinal extension of the first and second rods is essentially vertical and no cleaning liquid is fed from the first and second nozzles. In state E the spraying device is in the second mode. At states C, D, F and G the spraying device 16 is shifting between the first and second modes.

The heat transfer plates 4 are cleaned one at a time. Assuming that dirty heat transfer plates are at the right side of the apparatus 14 as seen in FIG. 1, the heat transfer plate to be cleaned is slid in a direction X, i.e. to the left, so as to be positioned in line with the bar 30 (step a). During this maneuver the spraying device is arranged in state E, i.e. in the second mode, whereby the first and second rods 18 and 22 are out of the way of the heat transfer plates 4. When the heat transfer plate to be cleaned is properly in place, the spraying device is rotated counter-clockwise around the rotation axis R while being moved in a direction opposite to D1, i.e. vertically and upwards, (state E→F) until it reaches state G (step b). Thereafter, the spraying device is moved, with its orientation maintained, further vertically and upwards until it reaches the first position P1 and state A (step c). Hereby, the apparatus is ready to start the cleaning of the heat transfer plate now arranged between the first and second rods such that the first nozzles 20 face a first side S1, and the second nozzles 24 face a second side S2, of the heat transfer plate (references S1 and S2 can be found in FIG. 1).

To start the cleaning the spraying device is put in the first mode whereby cleaning liquid is fed to the first and second nozzles (step d) and further onto the first and second heat transfer plate sides S1 and S2. The spraying device is moved in the first direction D1 until it reaches the second position P2 and state B (step e). Then, the feeding of cleaning liquid to the first and second nozzles is stopped (step f). Thereafter, the spraying device 16 is moved, with its orientation maintained, opposite the first direction D1 until it reaches state C (step g). After this, the spraying device is rotated clockwise around the rotation axis R while being further moved opposite the first direction D1 (state C→D) until it reaches state E (step h). The cleaned heat transfer plate is slid in the X direction past the spraying device 16 (step i). The above procedure may then be repeated to clean the rest of the heat transfer plates 4.

Thus, during step e, the spraying device is moved along the support bar such that the horizontally extending first and second rods are moved vertically from the first to the second point, i.e. along essentially the entire heat transfer plate. Meanwhile, the first and second nozzles are spraying cleaning fluid onto the first and second heat transfer plate sides to remove dirt from the same. As is clear from FIG. 2, the first and second nozzles are so many, and so distributed, that they cover the entire width of the heat transfer plate. Cleaning of essentially the entire heat transfer plate is thereby achieved. Since the heat transfer plate is washed from top to bottom, there is no risk of dirty cleaning liquid soiling already cleaned heat transfer plate portions. Since both sides of one and the same heat transfer plate are sprayed with cleaning liquid at the same time, there is no risk of heat transfer plate bulging. Otherwise, such bulging could disengage the heat transfer plates from the carrying and guiding bars. In that the first and second rods are provided with protective curtains, splashing of cleaning liquid to the surroundings are minimized.

When a heat transfer plate has been cleaned the spraying device is simply rotated and raised and thus moved out of the way of the heat transfer plates. The cleaned heat transfer plate may then be moved past the spraying device and a new plate may be moved into alignment with the support bar, i.e. into position for cleaning.

As described above, the protective curtains 38 extend upwards and downwards from the first and second rods 18 and 22. The protective curtains are provided with the upper and lower apertures 40 and 42 for receiving the carrying and guiding bars 10 and 12 to enable positioning of the spraying device 16 everywhere between state A and state B. Further, the spraying device 16 is horizontally arranged when moving from state G to state A and from state B to state C to prevent interference between the protective curtains 38 and the carrying and guiding bars 10 and 12.

The above described embodiment of the present invention should only be seen as an example. A person skilled in the art realizes that the embodiment discussed can be varied in a number of ways without deviating from the inventive conception.

For example, the first and second heat transfer plate sides S1 and S2 need not be the opposite sides of one and the same heat transfer plate but can be comprised in two adjacent heat transfer plates. In such a case, two or more heat transfer plates may be arranged to be positioned between the first and second rods at a time during cleaning liquid spraying.

The nozzle side of the first rod need not face the nozzle side of the second rod. As an example, the nozzle sides of the first and second rods could face away from each other. In such a case, the first and second rods could be arranged to be positioned on the same side of each heat transfer plate during cleaning liquid spraying.

The first and second rods could be provided with more than one nozzle side each, for example two opposite nozzle sides each. In such a case, four heat transfer plate sides could be cleaned at a time.

The spraying device could comprise more than two rods.

The spraying device could comprise any number of nozzles. The number and arrangement of the first nozzles need not be equal to the number and the arrangement of the second nozzles. The first and second nozzles need not be arranged on a respective straight line.

The spraying device could comprise different kinds of nozzles, stationary and/or movable nozzles. For example, the nozzles could be arranged to rotate, around their own respective, or another, axis.

The feeding of cleaning liquid to the nozzles need not be turned on and off as above described. As an example, the cleaning liquid feeding to the nozzles could be constant.

The spraying device need not be moved along, and rotated in relation to, the stationary support bar to shift between the different states. As an example, the spraying device could be arranged to always be horizontal instead of being rotated. In such a case, the spraying device could be moved between the different states by being horizontally and vertically displaced. As another example, the spraying device could be supported by a crane beam or similar.

Different means may be used for moving the spraying device up and down, and rotating the spraying device in relation to, the support bar, pneumatic pistons being one example. The spraying device could also be moved up and down the support bar and/or rotated manually.

In the above described embodiment the means for cleaning liquid supply include hoses feeding cleaning liquid from the cleaning liquid source to the first and second rods. Naturally, alternative solutions are possible. As an example, the cleaning liquid could be led to the first and second rods via the support bar by movable connections.

The protective curtains need not be provided with upper and lower apertures for receiving the carrying and guiding bars. For example, if the curtains are made of a flexible material, they may be bent out of the way when contacting the carrying and guiding bars so as to not hinder the movement of the spraying device. In such a case, the spraying device need not be horizontally arranged when moving from state G to state A and from state B to state C. Solutions enabling a proper cleaning of the heat transfer plates with a limited movement of the spraying device where the spraying device stops before contacting the carrying and guiding bars are also conceivable.

The order of the steps of the method could be altered. As an example, with reference to FIG. 5, step g could be performed before step f.

The first direction need not be vertical and downwards. For example. It could be vertical and upwards, horizontal or neither vertical nor horizontal.

The cleaning method could be performed more than once for each heat transfer plate, with the same or different cleaning fluids.

Any suitable cleaning fluid, and combinations of different cleaning fluids, could be used in connection with the present invention. As an example, the cleaning fluid could be regular water.

Finally, the present invention could be used in connection with other types of plate heat exchangers than purely gasketed ones, e.g. plate heat exchangers comprising permanently joined heat transfer plates.

It should be stressed that the attributes first, second, third, etc. is used herein just to distinguish between species of the same kind and not to express any kind of mutual order between the species.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. An apparatus for cleaning heat transfer plates suspended between end plates of an open plate heat exchanger, comprising:

a support bar fixed to the ground in an upright position;

a spraying device, the spraying device comprising:

a first rod;

at least a first nozzle arranged on a nozzle side of the first rod, the nozzle side of the first rod being arranged to face a first heat transfer plate side;

a second rod; and at least a second nozzle arranged on a nozzle side of the second rod, the nozzle side of the second rod being arranged to face a second heat transfer plate side, wherein the first and second rods are essentially parallel and connected, each of the first and second rods is pivotably connected to the support bar via a pivot mechanism directly on the support bar, and each pivot mechanism is movable along the support bar in a longitudinal direction of the support bar, such that each of the first and second rods is operable to pivot about the support bar in a plane parallel to an extension plane of the heat transfer plates while axially moving along the support bar in said longitudinal direction, wherein the spraying device is configured to be operable between:

a first mode in which the first and second rods are arranged to move between the heat transfer plates in the longitudinal direction of the support bar and parallel to the extension plane of the heat transfer plates while the at least first and second nozzles are arranged to spray cleaning fluid onto the first and second heat transfer plate sides, respectively; and a second mode in which the first and second rods are arranged to be in a position parallel with the support bar, such that the heat transfer plates are movable in a direction normal to the extension plane of the heat transfer plates to pass the spraying device, and wherein the spraying device further comprises a curtain arrangement including a first curtain extending from the first rod and a second curtain extending from the second rod, the at least first and second nozzles are arranged between the first and second curtains, and the curtain arrangement moves and pivots along with the first and second rods, and is arranged to stop splashing of the cleaning fluid.

2. The apparatus according to claim 1, wherein the spraying device, arranged in the first mode, is arranged to move from a first position to a second position in a first direction parallel to the longitudinal direction of the support bar, after which the spraying device is arranged to take the second mode to allow heat transfer plate passage, move opposite the first direction and return to the first mode and the first position.

3. The apparatus according to claim 1, wherein the spraying device is arranged to rotate about a rotation axis which is perpendicular to the extension plane of the heat transfer plates when shifting between the first and second modes.

4. The apparatus according to claim 2, wherein the spraying device engages with the support bar and is movable along the support bar to take the first and second positions.

5. The apparatus according to claim 1, wherein the nozzle side of the first rod faces the nozzle side of the second rod.

6. The apparatus according to claim 2, wherein said first direction is vertical and downward.

7. The apparatus according to claim 2, wherein the spraying device is arranged to rotate about a rotation axis which is perpendicular to the extension plane of the heat transfer plates when shifting between the first and second modes.

8. The apparatus according to claim 3, wherein the spraying device engages with the support bar and is movable along the support bar to take the first and second positions.

9. The apparatus according to claim 3, wherein the nozzle side of the first rod faces the nozzle side of the second rod.

10. A method of using the apparatus according to claim 1 for cleaning the heat transfer plates suspended between the end plates of the open plate heat exchanger 1 said method comprising the steps of:

moving the spraying device arranged in the first mode between the heat transfer plates and from a first position to a second position in a first direction parallel to the longitudinal direction of the support bar; and feeding cleaning fluid from the at least first and second nozzles onto the first and second heat transfer plate sides, respectively.

11. The method according to claim 10, further comprising the steps of:

moving the spraying device into the second mode in which the spraying device is arranged outside the heat transfer plates; and moving the heat transfer plates to pass the spraying device.

12. The method according to claim 11, further comprising the step of pivoting the first and second rods about the support bar in the plane parallel to the extension plane of the heat transfer plates when moving the spraying device between the first and second modes.

13. The method according to claim 10, further comprising the step of moving the spraying device opposite the first direction and into the first mode and the first position.

14. The method according to claim 10, wherein the nozzle side of the first rod faces the nozzle side of the second rod, the method further comprising the step of positioning the first and second rods on opposite sides of each of the heat transfer plates.

15. The method according to claim 10, wherein said first direction is vertical and downward.

* * * * *